United States Patent [19]

Malinowitz

[11] Patent Number: 5,039,053

[45] Date of Patent: Aug. 13, 1991

[54] CONCEALED TRASH RECEPTACLE

[76] Inventor: Irving Malinowitz, 4 Wendoyer La., Suffern, N.Y. 10901

[21] Appl. No.: 526,372

[22] Filed: May 21, 1990

[51] Int. Cl.[5] ..... A47K 1/08

[52] U.S. Cl. ..... 248/311.2; 248/99

[58] Field of Search ..... 248/311.2, 95, 99, 100, 248/101, 298, 128; 312/250, 270, 301, 307, 321, 335, 336

[56] References Cited

U.S. PATENT DOCUMENTS

| | | | |
|---|---|---|---|
| 860,822 | 7/1907 | Pitcher | 312/336 X |
| 1,135,704 | 4/1915 | Loftin | 312/335 X |
| 2,033,861 | 3/1936 | Otte | 312/336 X |
| 2,233,796 | 3/1941 | Pines | 312/337 X |
| 2,630,364 | 3/1953 | Gleason | 312/337 X |
| 3,201,072 | 8/1965 | Du Bois | 248/99 |
| 3,489,478 | 1/1970 | Beurkens | 312/336 X |
| 3,899,982 | 8/1975 | Fetzek | 312/335 X |
| 3,922,046 | 11/1975 | Schneider | 248/99 X |
| 4,653,818 | 3/1987 | DeBruyn | 312/335 X |
| 4,664,455 | 5/1987 | Greenhow | 248/99 X |

*Primary Examiner*—J. Franklin Foss

*Attorney, Agent, or Firm*—Stanley J. Yavner

[57] ABSTRACT

An under-counter trash receptacle, which includes an elongated steel frame, at one end of which is adjustably positioned a rear mounting bracket in order to accommodate varying depths of counter space. At the other end of the frame is a drawer-like slide defining a central opening into which is mounted a plastic trash receptacle.

2 Claims, 2 Drawing Sheets

CONCEALED TRASH RECEPTACLE

FIELD OF THE INVENTION

This invention relates primarily to kitchen furniture and appliances, and more particularly to concealed trash receptacles for use in a kitchen.

DESCRIPTION OF THE PRIOR ART AND BACKGROUND OF THE INVENTION

For the last thirty or forty years, kitchens have been built and remodeled to include ample counter space for providing a work surface and for enabling the addition of cabinets and appliances below such counter. For instance, dishwashers, and even refrigerators have been designed to fit below a kitchen counter. Also, a cabinet with doors, below the kitchen counter, is typically the place where a trash receptacle is located; and with the advent recently of compactors they also have been placed below kitchen counters.

There are, however, many households which either choose not to expend money on, or cannot afford, compactors, and therefore, it is particularly useful to provide more automated, and yet concealed trash receptacles, still mounted below the kitchen counter.

SUMMARY OF THE INVENTION

Accordingly a primary object of the present invention is to provide a trash receptacle, which is concealed, without the usual cabinet and swinging doors usually adapted for that purpose.

A further object of the present invention is to provide an easily accessible concealed trash receptacle for fitting below the kitchen counter.

Furthermore, it is an object of the present invention to provide an attractive structure, and yet a mostly concealed structure, for receiving trash and the like, but which can be conveniently slid in and out of a position below a kitchen counter.

These and other objects of the present invention are provided in a structure which features a steel frame, an adjustably positioned rear mounting bracket for fitting with that frame and a drawer-like slide which fits into the frame in a slidable fashion at the end of the frame opposite to where the rear mounting bracket fits. The slide defines a central opening into which is mounted a readily available trash receptacle of plastic or other suitable material. A particular feature of the present invention relates to the adjustable mount of the rear bracket, whereby the non-standard and varying depths of a kitchen counter may be addressed by the structure of the present invention.

BRIEF DESCRIPTION OF THE DRAWINGS

Other objects, features and advantages of the present invention will become apparent by reference to the following detailed description of a preferred, but nonetheless, illustrative, embodiment of the present invention, with reference to the accompanying drawings, wherein.

DETAILED DESCRIPTION OF THE PREFERRED EMBODIMENT

Figure 1:
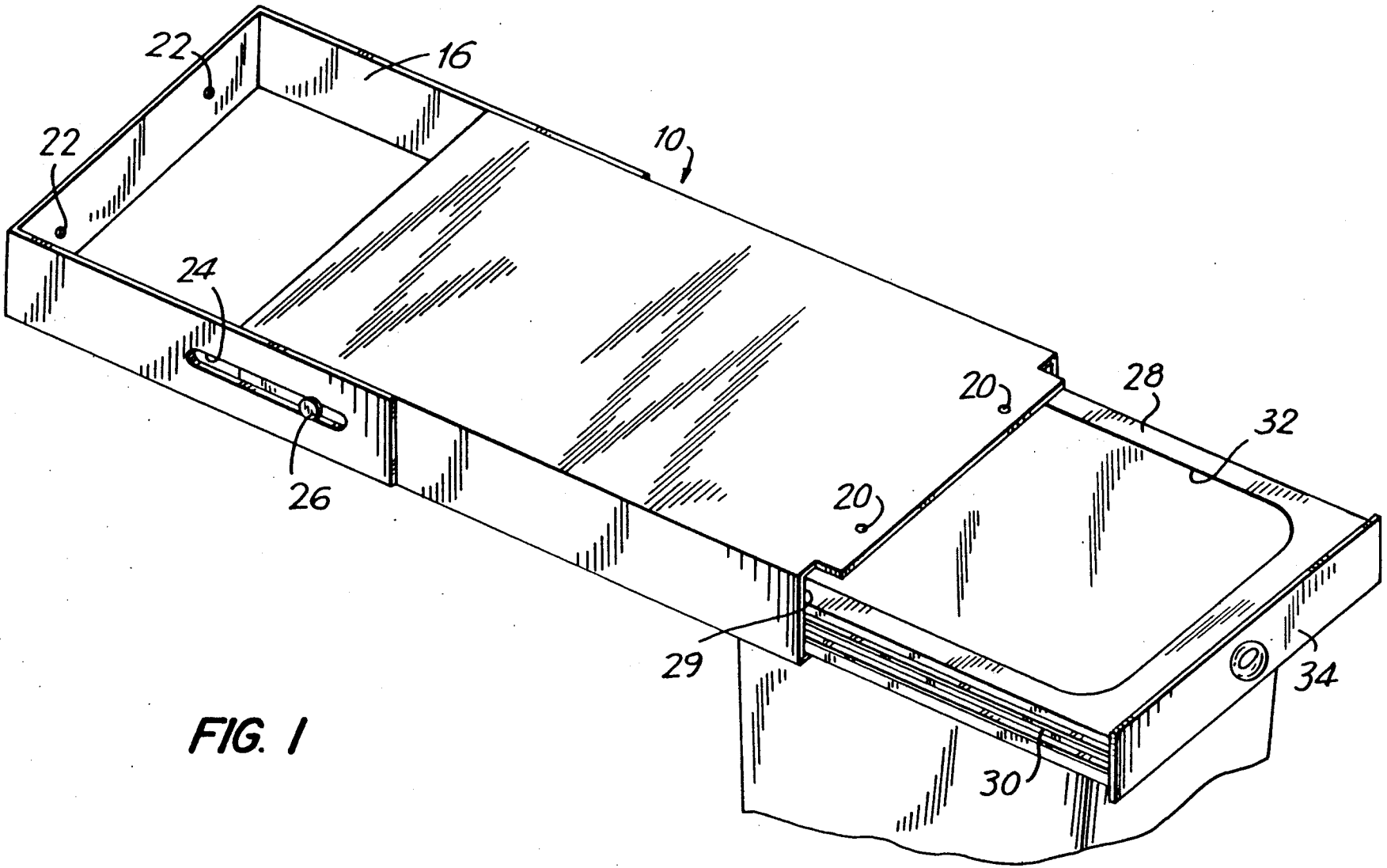
FIG. 1 is a top and left side isometric view of a structure of concealed trash receptacle according to the present invention.

Referring to the drawings, the present invention includes a steel frame 10, fastened by means of fasteners 12 to the underside of a kitchen counter generally designated 14. Kitchen counter 14 includes a top wall **14*a* and a depending rear wall 14*b*. Also included in the present invention is a rear mounting bracket 16 which fastens to rear wall 14*b* by means of fasteners 18, or the like. In terms of the foregoing, it may be seen (FIG. 1) that appropriate openings 20, 22 are defined by steel frame 10 and rear mounting bracket 16, respectively to enable use of fasteners 12, 18. Fasteners 12 are to hold frame 10 to the underside, front of wall 14*a***.

Rear mounting bracket 16 further defines a slot 24 or the like, for receiving a rivet 26 or the like, to couple steel frame 10 with rear mounting bracket 16, in an adjustable position, so that the dimension between the point where fasteners 12 and fasteners 18 are fixed, can be varied depending upon the depth dimension of the top wall **14*a*. By use of rivet 26, rather than, for instance, a set screw, a slidable relationship is maintained between steel frame 10 and rear mounting bracket 16, and the invention structure can be reused. Thus, before the artisan or the home owner fixes fasteners 18 and 12, the depth dimension of the top wall 14*a* of counter 14** can be addressed.

Slide 28 is also provided for the present invention, with side structure 30, to provide a drawer-like mating relationship between slide 28 and the inside side walls 29 of steel frame 10. Of course, such inside side walls 29 of steel frame 10 are presented with rollers or other features (not shown), which are provided commonly in kitchen cabinets and furniture to offer a drawer-like sliding relationship. In this case, the relationship is with slide 28.

Slide 28 defines a large central opening 32, into which is mounted either a standardly available 30-quart trash bucket or any other plastic or paper receptacle.

In order to provide a more complete description of the present invention, a series of assembly and use steps for the invention are now presented.

The frame 10 and rear mounting bracket 16 are placed into a coupled relationship, whereby rivets extend from steel frame 10 through the slot 24 defined in rear mounting bracket 16, and the invention structure can be reused. By holding such an assembly of steel frame 10 and rear mounting bracket 16 under the counter, in which it will be mounted, the position of rivets 16 is thereby determined. Fasteners 18 are then fixed through openings 22 into the depending rear wall **14*b* of counter 14. Likewise, fasteners 12 are then fixed through openings 20 into the outermost lip of counter 14. Rivets 26 are thereby adjusted into a proper position, and the item is readied for use by placing a trash receptacle within central mounting opening 32, after which slide 28 is then mated with steel frame 10** in the drawer-like slidable relationship, previously mentioned.

Figure 2:
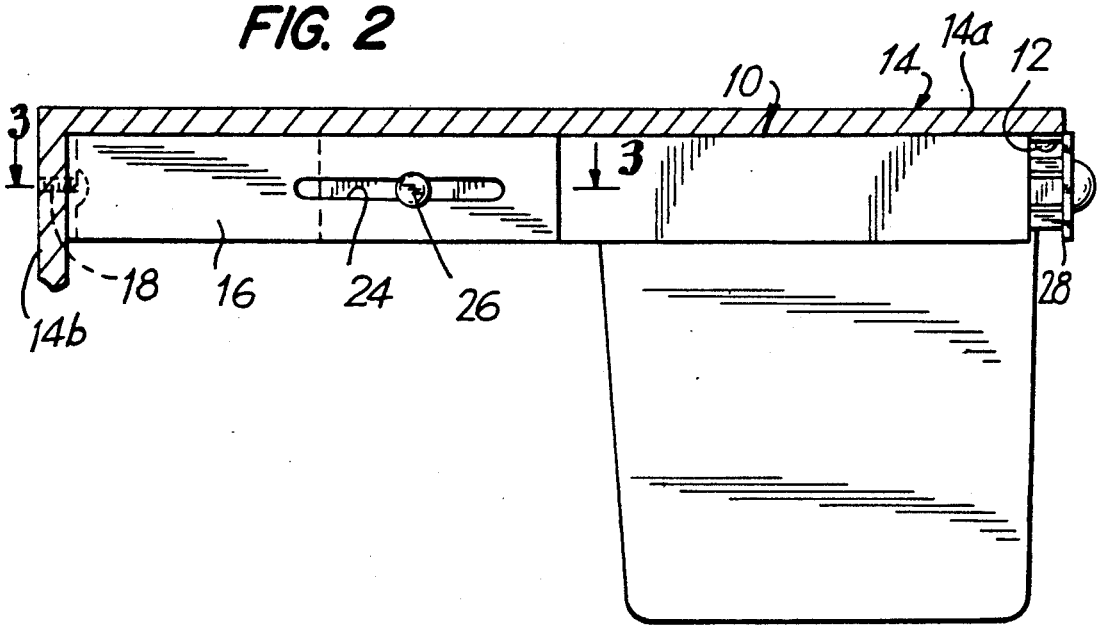
FIG. 2 is a left side view thereof, showing the particular relationship of the present invention with a kitchen counter.
Figure 3:
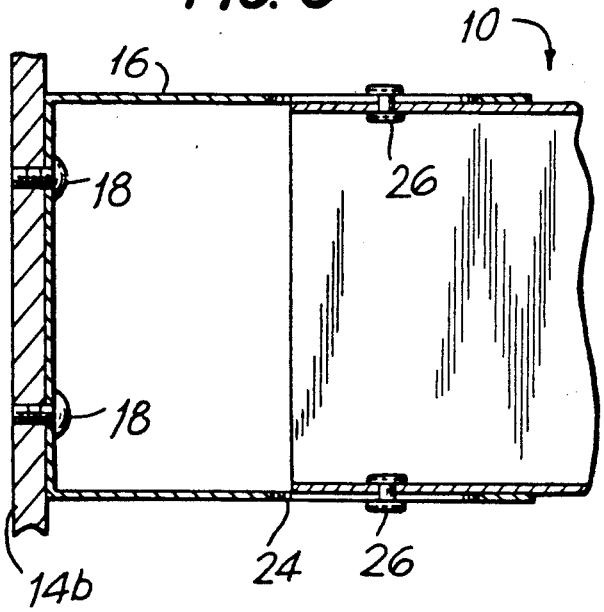
FIG. 3 is a top, sectional view of the steel frame and adjustably-mated rear mounting bracket, the section being taken along the line 3—3 of FIG. 2.

Of course, front 34 of slide 28 can either be of the approximate dimensions shown in FIGS. 1 and 2, or extending all the way to the floor in an attractive facade. If it is in the dimensions indicated in the drawings, it mates attractively with cabinet doors or the like, located immediately below it. The use of either such design is simply a matter of choice.

In use, the depositing of trash therein is performed simply by sliding out from the structure slide 28, depositing such trash through opening 32 into the selected trash receptacle and reinserting slide 28 within the balance of the structure. Emptying the trash is also simplified, by withdrawing slide 28 toward the user, removing the entire trash receptacle from opening 32 and replacing it with another disposable receptacle.

The foregoing provides a complete description of an attractive, useful and convenient trash receptacle, which may be permanently mounted under counters of varying depth dimensions. Notwithstanding the description provided, the present invention is to be limited only by the following claims:

What is claimed is:

1. A trash receptacle structure, including means for holding a trash receptacle for mounting below a kitchen counter, comprising an elongated frame having two ends, a rear mounting bracket and a drawer-like slide, said rear bracket adjustably coupled to one end of said frame, said slide slidably coupled to the other end of said frame and defining a central opening, into which said trash receptacle is mounted, said bracket being generally U-shaped, with a pair of side walls and a back wall, means for fastening said back wall and means for fastening the other end of said frame to said counter, said adjustable coupling between said frame and said bracket enabling the variation of the distance between said means for fastening, and thereby enabling variations in the size of the counter with which said trash receptacle is used.

2. The invention according to claim 1, wherein means are provided for slidably coupling said slide and said frame.

* * * * *